US005524818A

United States Patent [19]

Patry et al.

[11] Patent Number: 5,524,818

[45] Date of Patent: Jun. 11, 1996

[54] OUTGOING MAIL SIGNAL DEVICE

[76] Inventors: Michael J. Patry, 825 Fox Tail Dr.; Michael W. Blasdel, 5001 Jessie James Dr., both of Edmond, Okla. 73034

[21] Appl. No.: 555,782

[22] Filed: Nov. 9, 1995

[51] Int. Cl.[6] ..... B65D 91/00

[52] U.S. Cl. ..... 232/35

[58] Field of Search ..... 232/34, 35, 17

[56] References Cited

U.S. PATENT DOCUMENTS

| | | | |
|---|---|---|---|
| 2,808,982 | 10/1957 | Armstrong | 232/35 |
| 2,856,123 | 10/1958 | Mary | 232/35 |
| 2,988,268 | 6/1961 | Mioduski | 232/35 |
| 3,498,256 | 3/1970 | Hebal | 116/132 |
| 4,655,390 | 4/1987 | Martin | 232/35 |
| 5,119,986 | 6/1992 | Kobilarcik et al. | 232/35 |
| 5,284,295 | 2/1994 | Steinfeldt | 232/35 |
| 5,388,759 | 2/1995 | Barnes | 232/35 |

*Primary Examiner*—Jerry Redman

[57] ABSTRACT

An improved outgoing mail signal device for use on rural mailboxes which are partially enclosed by decorative structures such as those composed of brick (or stone) and mortar. The device comprises a support bracket mounted to the door of the mailbox and a signal arm pivotably coupled to the bracket. In operation, the signal arm is rotated up to a stable, over-centered, raised position to indicate the presence of outgoing mail. Upon opening the door, the signal arm returns to the lowered position automatically under the action of gravity. The device has only two stable rest positions, fully raised and fully lowered, for unambiguous signaling. To a viewer located to the side of the mailbox, the signal arm is highly visible when in the raised position and hidden from view when in the lowered position.

4 Claims, 3 Drawing Sheets

OUTGOING MAIL SIGNAL DEVICE

BACKGROUND OF THE INVENTION

1. Field of the Invention

This invention relates to the signal flag used on a rural mailbox to indicate the presence of outgoing mail. Specifically, the present invention relates to such a flag that is designed for use on mailboxes which are partially enclosed by decorative structures such as those composed of brick (or stone) and mortar.

2. Description of the Prior Art

Rural, freestanding mailboxes are well known and are in widespread use. In the past, these mailboxes were mainly found in less developed (rural) areas, such as farms. The mailbox, with its standard outgoing mail flag, was typically located a considerable distance from the house and often placed on the other side of the road. Due to this inconvenient location, many devices have been proposed to indicate that mail was delivered (without requiring the owner to look inside the box). Examples of these delivery signaling devices include U.S. Pat. Nos. 5,284,295 to Steinfeldt (Feb. 8, 1994), 5,388,759 to Barnes (Feb. 14,1995), 2,856,123 to Mary (Oct. 14, 1958), and 4,655,390 to Martin (Apr. 7, 1987). These devices were intended to be used in addition to the standard outgoing mail flag. Generally, the rural mailboxes described in these examples were simply mounted on a post. The mailbox had no enclosing structure and its supporting structure did not interfere with proper operation of either flag. Since there was no problem with the proper operation of the outgoing mail flag in this simple configuration, there was no need to devise a solution.

These rural mailboxes are currently being used in more suburban settings, where they are located closer to the house. Now their appearance is much more important to the homeowner. To improve their appearance, many of these mailboxes are being partially enclosed by decorative structures such as those composed of brick (or stone) and mortar, often similar to the house. In this configuration, only the front two inches or less of the mailbox protrudes from the structure. Therefore, the standard, side mounted, outgoing mail flag and its bracket cannot be used, and there is insufficient room to move the flag and its bracket to another location on the exposed portion of the mailbox. In many cases, the original flag, with or without its bracket, is moved to the side of the surrounding brick structure. This action has many disadvantages, including:

(a) The flag rubs on the brick, leaving circular wear marks which are unsightly.

(b) The brick wears the paint off the flag causing it to rust.

(c) The flag is not within easy reach of the postal carrier, particularly when reaching out of the window of a vehicle.

(d) The irregular surface of the enclosure catches on the flag, often necessitating that the flag be bent out from the structure, further detracting from its appearance.

(e) When mounted without its bracket, the flag can be rotated 360 degrees. Only frictional contact with the brick holds it in position.

(f) These flags can be positioned at a point that is in-between the fully lowered and the fully raised positions, leading to possible confusion as to whether outgoing mail is present. The prior art describes several variations of standard outgoing mail flags as typified by U.S. Pat. Nos. 5,119,986 to Kobilarcik et al. (Jun. 9, 1992) and 2,988,268 to Mioduski (Jun. 13, 1961). These devices would be rendered inoperable if used on an enclosed mailbox. In fact, flags such as these must either be removed from the mailbox prior to enclosing it or mortared into the enclosing structure.

Alternatives to the standard flag have also been proposed. U.S. Pat. No. 3,498,256 to Hebal (Mar. 3, 1970), describes a flag which is magnetically held in the raised position. This flag requires an exposed area on the side of the mailbox just like the standard flag and is therefore not usable on an enclosed mailbox. If this flag were to be mounted to the door of the mailbox, the flag's surface would lie in a plane parallel to the street, greatly reducing its visibility (when viewed from the side). A further disadvantage is that this flag does not provide a self-lowering feature, requiring the postal cartier to manually lower it.

Another alternative design is the "Post Alert Slide", manufactured by Beacon Industries of South Jordan, Utah 84065, marked Pat. Pending. This device comprises a thin rectangular housing with a flag that slides out to indicate the presence of outgoing mail. In each case where this device was seen on a mailbox, the flag was difficult to slide in and out, possibly due to dirt and debris entering the housing and becoming lodged in the internal guide channels. Another disadvantage is that the flag of this device can be positioned in-between the fully out and fully in positions, causing confusion as to whether or not it is indicating the presence of outgoing mail. Still a further disadvantage is that a portion of the flag sticks out from the housing at all times, again causing confusion. A further disadvantage is that this flag must be manually pushed back into its housing after the mailbox has been serviced. Also, when mounted to the side of the enclosing structure, it is not within easy reach of the postal carrier.

The dissatisfaction with the performance and appearance of available outgoing mail flags used with mailboxes which are partially enclosed by a decorative structure is the likely cause of a growing trend to leave the flag off altogether. However, the postal carrier is not required to stop and check a mailbox unless a signal flag indicates the presence of outgoing mail. By not using a flag, the homeowner risks that the outgoing mail will not be picked up.

OBJECTS AND ADVANTAGES

Accordingly, there remains a need for an outgoing mail signal device which is designed for use on mailboxes which are partially enclosed by decorative structures. The several objects and advantages of the present invention are:

(a) to provide an outgoing mail signal device which is designed for use on mailboxes which are partially enclosed by decorative structures such as those composed of brick (or stone) and mortar;

(b) to provide an outgoing mail signal device which, when viewed from the side, is highly visible when in the raised position but hidden from view when in the lowered position;

(c) to provide an outgoing mail signal device which can only be positioned fully raised or fully lowered so there is never any confusion as to what status the device is indicating;

(d) to provide an outgoing mail signal device with a self-lowering feature;

(e) to provide an outgoing mail signal device that when mounted to the mailbox door does not interfere with delivery/pickup of the mail;

(f) to provide an outgoing mail signal device which is simple to manufacture and is composed of inexpensive materials; and (g) to provide an outgoing mail signal device that can be easily installed.

Still further objects and advantages of the present invention will become apparent from a consideration of the ensuing drawings and description.

Figure 1:
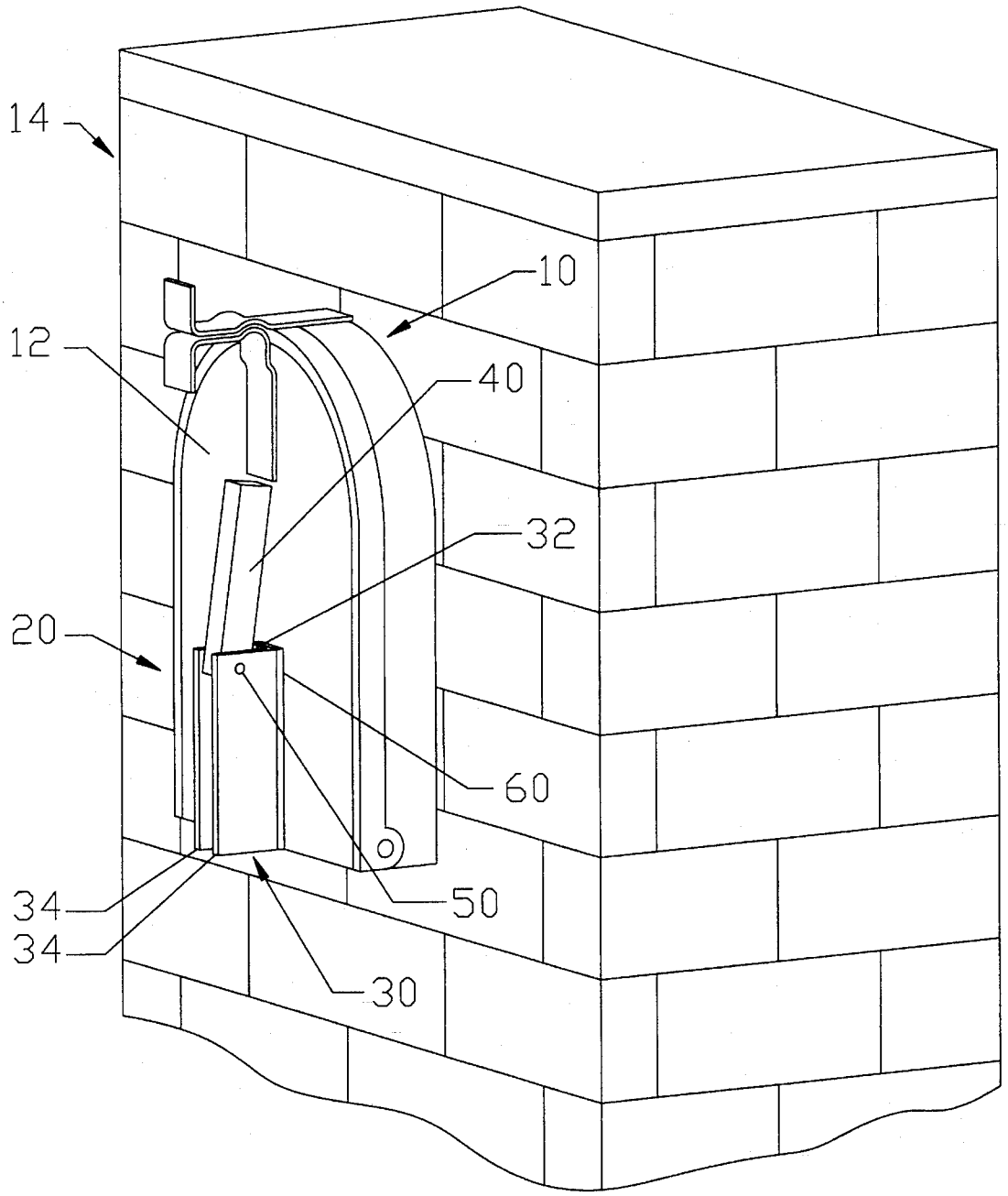
FIG. 1 is an illustration in perspective of a rural mailbox which is partially enclosed by a representative brick and mortar structure, having the outgoing mail signal device of this invention attached thereto.

| REFERENCE NUMERALS IN DRAWINGS | |
|---|---|
| 10 standard rural mailbox | 40 signal arm |
| 12 hinged door | 42 hole in side leg(s) |
| 14 enclosing structure | 46 hole in signal arm |
| 20 outgoing mail signal device | 50 binding screw |
| 30 support bracket | 52 post |
| 32 base | 54 screw |
| 34 side leg(s) | 60 double-sided adhesive tape |

DESCRIPTION OF THE PREFERRED EMBODIMENT

Referring now to the drawings, FIG. 1 shows the from portion of a standard rural mailbox 10, with a hinged door 12. The mailbox is shown protruding slightly from the front (street facing) side of a representative enclosing structure 14 composed of brick and mortar. The outgoing mail signal device is generally indicated by reference numeral 20, and is seen to comprise two main components, namely a support bracket 30 and a signal arm 40.

Figure 2:
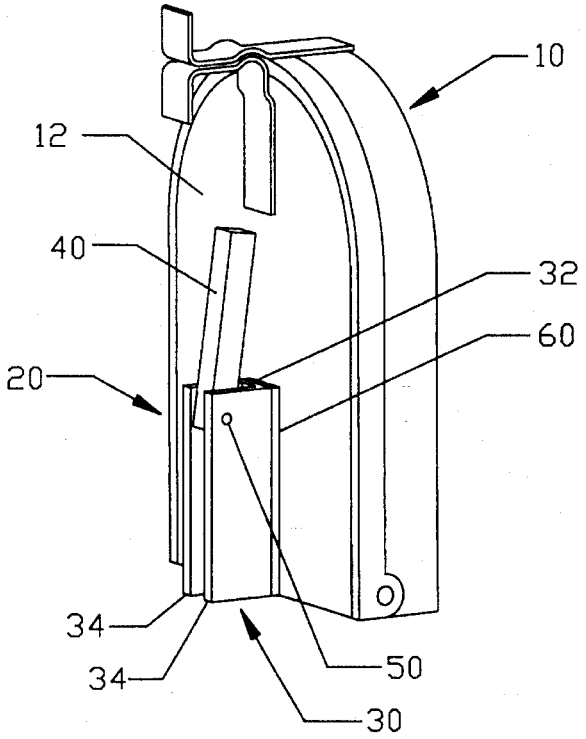
FIG. 2 is a perspective view of the device attached to the front of a rural mailbox, showing the signal arm in the raised position to indicate the presence of outgoing mail.
Figure 3:
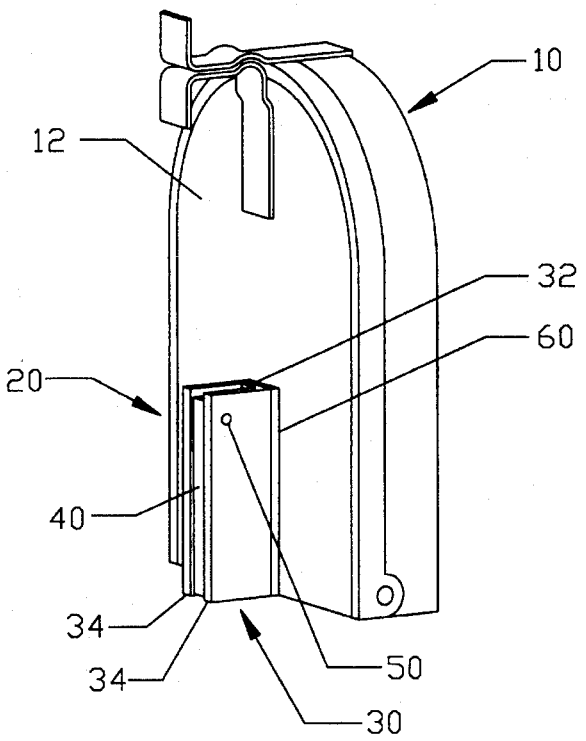
FIG. 3 is a perspective view of the device attached to the front of a rural mailbox, showing the signal arm in the lowered position.
Figure 4:
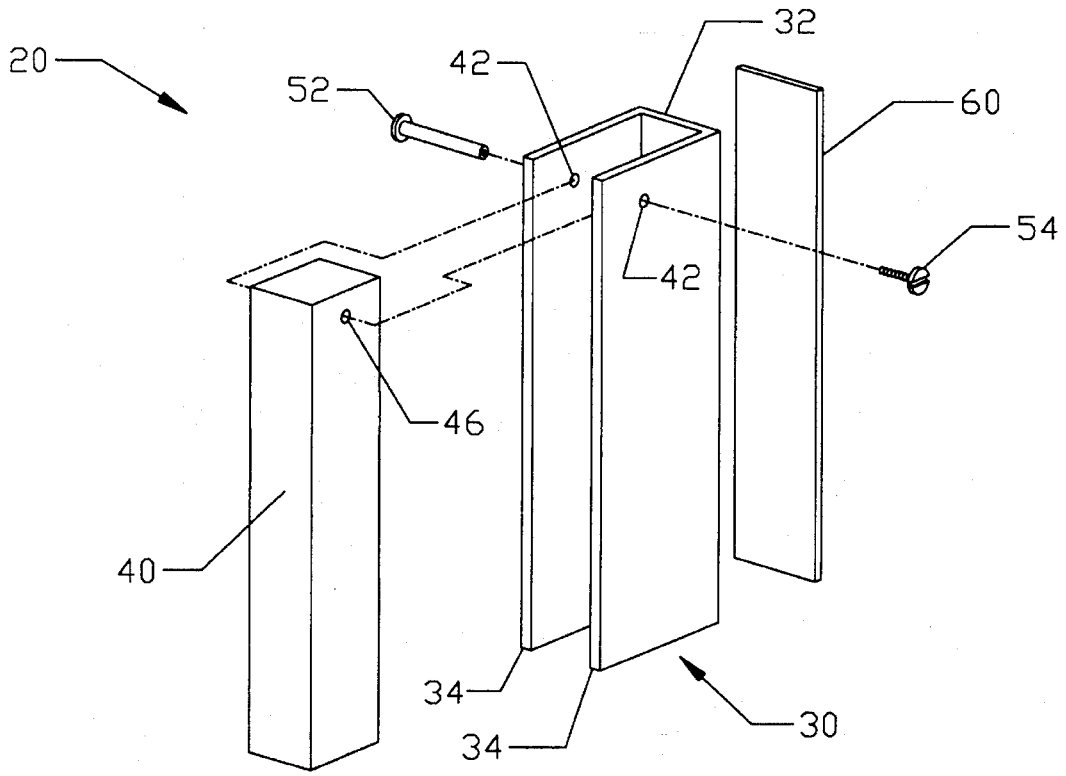
FIG. 4 is an exploded view of the device.

Referring to FIGS. 2, 3, and 4, support bracket 30 is generally U-shaped, comprising a base 32 and two side legs 34. Support bracket 30 is shown in its preferred location, centered on the lower edge of the outer surface of door 12. The bracket is permanently secured to the door with a double-sided adhesive tape 60. Aligned holes 42 are provided in the upper ends of side legs 34 of support bracket 50. A hole 46 is also provided in one end of signal arm 40. A binding screw 50, including a post member 52 and a screw member 54 is passed through aligned holes 42 and 46 to pivotably couple signal arm 40 to support bracket 30.

Signal arm 40 is sized to fit somewhat loosely between side legs 34 to ensure free movement of the arm. Similarly, hole 46 is purposely of a slightly larger diameter than binding screw 50 so as to provide a somewhat loose but secure pivotal attachment. In this way, the likelihood of dirt or ice jamming the signal arm is greatly reduced.

Support bracket 30 and signal arm 40 are preferably composed of a weather resistant plastic material, such as an acrylic. Binding screw 50 is preferably composed of a flexible polyethylene material for post 52 and a rigid nylon material for screw 54.

OPERATIONAL DESCRIPTION

The owner who wishes to indicate the presence of outgoing mail sets the device by closing door 12 and rotating signal arm 40 until it leans back against the outer surface of the door, as shown in FIGS. 1 and 2. This position is the fully raised position. The force of gravity acting on the free end of the signal arm assures that the arm will remain in this stable, over-centered, rest position. In this position, the brightly colored signal and is highly visible to the postal cartier approaching from the side of the mailbox. The act of raising the signal arm also performs a self-cleaning action, sweeping debris out from between the arm and side legs 34.

Upon opening of door 12, as when the postal carrier acts to remove outgoing mail from mailbox 10, signal arm 40 pivots about the axis of binding screw 50 to a free-end-down position, as dictated by gravitational force. The signal arm remains in this free-end-down orientation as the door is returned to the vertical or closed position. FIG. 3 shows the signal arm in this final, fully lowered position, at a stable rest between side legs 34 of support bracket 30. This self-lowering feature of the device is accomplished without complex mechanical linkages which are prone to binding and failure. By self-lowering, the device eliminates the need for the postal cartier to manually lower the signal arm.

If the owner does not have outgoing mail, signal arm 40 is simply left in the fully lowered position as shown in FIG. 3. Side legs 34 of the support bracket effectively hide the signal arm from view as the postal carrier approaches from the side of the mailbox. Since the device clearly indicates the lack of outgoing mail, an unnecessary stop to examine the mailbox is avoided.

A key feature of the device is that signal arm 40 has only two stable rest positions when door 12 is closed. When the arm is in the fully raised position to indicating the presence of outgoing mail, the arm is leaning against the door as depicted in FIG. 2. When the arm is in the fully lowered position indicating the lack of outgoing mail, the arm is hanging down vertically between side legs 34 of the support bracket as depicted in FIG. 3.

Figure 5:
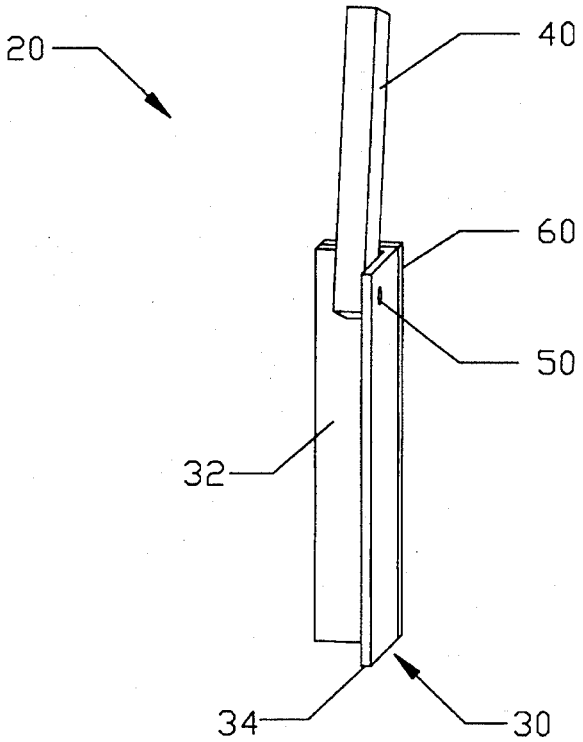
FIG. 5 is a perspective view of an alternate embodiment of the device, where there is only one side leg.

Referring now to FIG. 5, reference numeral 20 generally indicates an alternate embodiment of the present device wherein support bracket 30 comprises base 32 and only one side leg 34 attached thereto. The operation of this simplified version of the device is the same as previously illustrated. When signal arm 40 is in the lowered position, the single side leg still hides the signal arm from view when the postal carrier approaches from the fight hand side of the mailbox.

While the foregoing describes the preferred embodiment of the subject invention, it will be readily apparent to those skilled in the art that variations may be made without departing from the spirit of the invention or the scope of the following claims.

We claim:

1. An outgoing mail signal device for use on a rural mailbox including a hinged door located on a front side which swings from a closed position downwardly to an open position, said hinged door having an outer surface, the device comprising:

a support bracket comprising a base and a side leg;

a mounting means for permanently attaching said support bracket to said outer surface of said hinged door;

a signal arm;

a pinning means for pivotably coupling said signal arm at one end to said support bracket, said pinning means located a sufficient distance from said base so as to allow said signal arm to be rotated to an over-centered, stable rest position when fully raised;

said side leg being of sufficient size to fully conceal said signal arm when said signal arm is in a lowered position and an observer is located on one side adjacent to the front side of said rural mailbox, whereby an owner may clearly indicate a presence of outgoing mail requiring pick-up, even though said rural mailbox is partially enclosed by a structure which would interfere with a proper operation of a standard outgoing mail flag.

2. The device of claim 1 wherein said signal arm is composed of a transparent, red colored, acrylic material, whereby a conduction of ambient light causes said signal arm to appear to glow, thereby enhancing visibility.

3. An outgoing mail signal device for use on a rural mailbox including a hinged door located on a front side which swings from a closed position downwardly to an open position, said hinged door having an outer surface, the device comprising:

a support bracket comprising a base and two side legs;

a mounting means for permanently attaching said support bracket to said outer surface of said hinged door;

a signal arm which is sized to fit between said side legs of said support bracket;

a pinning means for pivotably coupling said signal arm at one end to said support bracket, said pinning means located a sufficient distance from said base so as to allow said signal arm to be rotated to an over-centered, stable rest position when fully raised;

said side legs being of sufficient size to fully conceal said signal arm when said signal arm is in a lowered position and an observer is located on one side adjacent to the front side of said rural mailbox, whereby an owner may clearly indicate a presence of outgoing mail requiring pick-up, even though said rural mailbox is partially enclosed by a structure which would interfere with a proper operation of a standard outgoing mail flag.

4. The device of claim 3 wherein said signal arm is composed of a transparent, red colored, acrylic material, whereby a conduction of ambient light causes said signal arm to appear to glow, thereby enhancing visibility.

* * * * *